US006475978B1

(12) United States Patent
Appel et al.

(10) Patent No.: US 6,475,978 B1
(45) Date of Patent: Nov. 5, 2002

(54) METHOD OF MAKING WATER-SOFTENING AND DETERGENT COMPOSITIONS

(75) Inventors: Peter Willem Appel, Vlaardingen (NL); Roger Joseph Janssen, Vlaardingen (NL)

(73) Assignee: Unilever Home & Personal Care USA a division of Conopco, Inc., Greenwich, CT (US)

( * ) Notice: Subject to any disclaimer, the term of this patent is extended or adjusted under 35 U.S.C. 154(b) by 75 days.

(21) Appl. No.: 09/631,245

(22) Filed: Aug. 2, 2000

(30) Foreign Application Priority Data

Aug. 5, 1999 (GB) ..... 9918505

(51) Int. Cl.[7] ..... C11D 11/00

(52) U.S. Cl. ..... 510/446; 510/224; 510/294; 510/298; 510/488

(58) Field of Search ..... 510/446, 224, 510/294, 298, 488

(56) References Cited

U.S. PATENT DOCUMENTS

| | | | | | |
|---|---|---|---|---|---|
| 4,587,031 | A | | 5/1986 | Kruse et al. | 252/135 |
| 4,756,838 | A | | 7/1988 | Veltman | 252/1 |
| 4,839,078 | A | * | 6/1989 | Kruse et al. | 510/224 |
| 4,883,833 | A | * | 11/1989 | Hughes | 524/394 |
| 4,897,212 | A | | 1/1990 | Kruse et al. | 252/99 |
| 5,672,555 | A | | 9/1997 | Maxwell et al. | 501/147 |
| 6,093,688 | A | * | 7/2000 | Gordon | 510/224 |
| 6,153,574 | A | * | 11/2000 | Janssen | 510/224 |
| 6,174,848 | B1 | * | 1/2001 | Dawson et al. | 510/297 |
| 6,242,403 | B1 | * | 6/2001 | Lammers et al. | 510/294 |
| 6,271,190 | B1 | * | 8/2001 | Boskamp et al. | 510/446 |
| 6,310,028 | B1 | * | 10/2001 | Janssen | 510/446 |

FOREIGN PATENT DOCUMENTS

| | | |
|---|---|---|
| DE | 247 840 | 7/1987 |
| DE | 264 701 | 4/1988 |
| EP | 522 766 | 1/1993 |
| EP | 711 827 | 5/1996 |
| EP | 838 519 | 4/1998 |
| EP | 881 282 | 12/1998 |
| EP | 971 028 | 1/2000 |
| GB | 911204 | 11/1962 |
| GB | 2 318 575 | 4/1998 |
| WO | 90/02165 | 3/1990 |
| WO | 99/53014 | 10/1999 |
| WO | 00/22089 | 4/2000 |
| WO | 00/32741 | 6/2000 |

OTHER PUBLICATIONS

Derwent Abstract of JP 07 278044—published Oct. 24, 1995.

* cited by examiner

*Primary Examiner*—Lorna M. Douyon
(74) *Attorney, Agent, or Firm*—Rimma Mitelman

(57) ABSTRACT

The speed of disintegration of tablets containing a water-softening agent, especially water-insoluble, water-softening agent intended as detergency builder for fabric washing is enhanced by incorporating granules containing acetate (sodium acetate and/or potassium acetate) along with at least one other ingredient. Such tablets are provided, as are, methods of making the granules.

20 Claims, No Drawings

METHOD OF MAKING WATER-SOFTENING AND DETERGENT COMPOSITIONS

This invention relates to compositions in the form of tablets, containing a water-softening agent, methods of making a granular material for use in these tablets, and methods of making these tablets. These tablets may be embodied as detergent compositions for use in fabric washing, or as water-softening tablets, which could be used in fabric washing jointly with a composition containing detergent active, or could possibly be used in other applications, e.g. in machine dishwashing as an anti-limescale product.

Detergent compositions in tablet form have been described in a number of documents including, for example, GB 911204 (Unilever), WO 90/02165 (Henkel) and EP-A-711827 (Unilever) and are sold now commercially. Tablets have several advantages over powdered products: they do not require measuring and are thus easier to handle and dispense into the washload, and they are more compact, hence facilitating more economical storage.

Detergent tablets are generally made by compressing or compacting a detergent powder, which includes detergent active and detergency builder. EP-A-522766 explains that difficulty has been found in providing tablets which have adequate strength when dry, yet disperse and dissolve quickly when added to wash water. The problem has proved especially difficult with compositions containing insoluble aluminosilicate as detergency builder but also arises with compositions which contain sodium tripolyphosphate or other water-soluble builder.

EP-A-711827 teaches that speed of disintegration of tablets can be improved by including the highly water-soluble salt, sodium citrate. Tablet compositions exemplified in that document include sodium citrate dihydrate and also polyethylene glycol as an organic polymeric binder. This document briefly mentions that sodium acetate can be included in a composition as a lubricant to aid tableting. No information is given concerning the form in which sodium acetate might be incorporated as a lubricant. The amount of lubricant is not stated, but it would be appropriate to include only a small amount.

Detergent tablet compositions comprising acetates are also known from EP 264 701.

Detergent compositions comprising acetate are also known from DD 247 840, GB 2 318 575, EP 881 282 and U.S. Pat. No. 4,587,031. The inter-calcinating of potassium acetate molecules in clay particles is known from U.S. Pat. No. 5,672,555.

EP-A-838519 discloses that sodium acetate trihydrate and potassium acetate can function alone, or together, or in combination with sodium citrate dihydrate as effective tablet disintegrants in water-softening tablets. When mixtures of salts are used, crystals of each salt are incorporated into the overall mixture.

Surprisingly, we have now found that the amount of acetate in a tablet can be reduced whilst maintaining tablet solubility, by providing the acetate granulated with other ingredients in the same granule. These granules can be included in the tablet in approximately the same amount as known acetate granules or powder and have greater effect on the tablet solubility than might be expected from their content of acetate alone.

Broadly, the present invention provides a tablet of a compacted particulate composition wherein the tablet or a region thereof contains a water-softening agent and either sodium acetate or potassium acetate or both (the acetate), wherein the acetate is present in granules which contain at least one other ingredient.

The amount of water-softening agent will generally be at least 15% by weight of the composition of the tablet or region thereof. Depending on the function for which the tablets are intended the amount may range up to 90% by weight. In significant forms of this invention there is at least 15%, by weight of the composition, of a water-insoluble water softening agent.

Generally, the content of acetate in these granules is at least 0.1 mole per 100 gram of granules.

Thus, if the acetate is present as sodium acetate trihydrate, the weight percentage of sodium acetate trihydrate in the granules will be at least 13.6% of their weight. If, however, the acetate is present as anhydrous sodium acetate the amount of sodium acetate in the granules will thus be at least 8.2% of their weight. It is also possible that the sodium acetate is present in a partially hydrated form.

If the acetate is present as potassium acetate, the amount of potassium acetate in the granules will be at least 9.8% of their weight.

The acetate may be present as a mixture of any of these forms.

The lower limit of the acetate content of the granules may be 0.15, 0.25 or even 0.3 mole per 100 gram of granules.

It is unlikely that the content of acetate in the granules will exceed 1 mole per 100 gram of granules. Indeed, that content cannot be achieved with fully hydrated sodium acetate. The content may not exceed 0.65 mole per 100 gram of granules which would correspond to 53% by weight of anhydrous sodium acetate, 88% of sodium acetate trihydrate, or 66% by weight of potassium acetate.

A water-softening tablet of the invention is likely to contain at least 10% by weight of these acetate-containing granules, possibly at least 13% or 15%. It is unlikely that it will contain more than 35% of the granules, and may contain only up to 22% or 30% of the granules.

Accordingly, one aspect the present invention provides a tablet of a compacted particulate composition wherein the tablet or a region thereof comprises from 15 to 90% by weight of a water-softening agent, sodium and/or potassium acetate and optionally other ingredients, characterised in that the tablet or region contains at least 10% by weight of granules which contain both said acetate and at least one other ingredient, the content of said acetate in these granules being at least 0.1 mole per 100 gram of granules and the other ingredients being at least 5% by weight of the granules. Thus the acetate is no more than 95% by weight of the granules.

The total content of the acetate in the tablet or region may be only 0.01 Mol/100 g, or it may be 0.02 Mol/100 g, or 0.05 Mol/100 g. It is likely that there will be no more than 0.425 Mol/100 g of the acetate in the tablet or region, and the upper limit may be 0.3 Mol/100 g, or as low as 0.2 Mol/100 g, 0.15 Mol/100 g or even 0.1 Mol/100 g.

It is preferred that more than half of all the acetate in the tablet or region is contained in the granules, and as much as 75%, 90% or even all of the acetate may be in the granules (hereinafter referred to as "co-granules").

It is also preferred that the acetate is sodium acetate.

By reducing the amount of acetate required in a tablet to achieve satisfactory dissolution times, the present invention allows the amounts of other ingredients in the tablets to be increased may enable improvements in performance of the tablets to be made.

It is further preferred that the other ingredients of the co-granule are present in an amount of at least 10, 15 or 20% by weight of the granules.

It is also preferred that when the acetate is sodium acetate, the amount of water (bound or unbound) present in the co-granules is such as to be in a molar ratio of 2.5:1 to 3.5:1 to the sodium acetate. A second aspect of the invention provides a method of making the acetate co-granules described above, including the steps of neutralising acetic acid with a solid basic compound and granulating the resulting mixture, wherein in that the amount of solids added to the acetic acid includes sufficient basic compound to neutralise the acetic acid, and further material which forms the co-granule with the acetate.

In one embodiment, at least some or all of the further material is the same as the basic compound, so that an excess of the basic compound, compared to the stoichiometric amount required for neutralisation, is added to the acetic acid.

This method may be used to make granules containing either sodium or potassium acetate or both. The nature of the acetate depends on the solid basic compound used.

If making sodium acetate, it is preferred that the acetic acid is used in solution rather than as its glacial form, in order that the resulting sodium acetate may be at least partially hydrated.

A third aspect of the invention provides an alternative method of making the sodium acetate co-granules described above, including the steps of heating a hydrated form of sodium acetate above its melting point, and granulating the resulting melt with at least one solid tablet ingredient.

The method of the second or third aspects may be extended by the addition of the resulting acetate-containing co-granules to further ingredients to form a particulate composition as described in the first aspect of this invention. This particulate composition may be a detergent composition, as described in more detail below.

It is strongly preferred that the acetate co-granules have a mean particle size of above 250 μm, preferably above 300 μm (0.3 mm), better above 500 μm (0.5 mm) to facilitate flow and handling of the particulate composition prior to and during compaction. The particle size will probably have a mean value less than 2 mm, preferably less than 1 mm. Poor powder flow is disadvantageous, inter alia, in that it leads to irregular filling of dies and inconsistent tablet weight and strength.

Details of suitable materials, as well as further preferences, will now be described.

Sodium Acetate

Sodium acetate is well-known in anhydrous and trihydrated forms.

The anhydrous form is a hygroscopic powder, which is very soluble in water (119 g/100 g at 20° C.)—Mol wt 82 g.

The trihydrate is available as transparent crystals or granules (and has a solubility of 76 g/100 g at 20° C.)—Mol. wt. 136 g. When heated, it melts at 58° C.—the melting process is the sodium acetate dissolving in its own water of crystallisation, and thus producing a very concentrated solution. This 'melt' becomes anhydrous, due to evaporation of the water if heated to 120° C.

Sodium acetate is also commercially available in a spray-dried form, which does not have an integral number of water molecules per acetate. Such a form is made by spray-drying a solution of sodium acetate. The sodium acetate solution which is spray-dried may be a heated concentrated solution of sodium acetate, which itself may be made by the direct neutralisation of acetic acid in caustic soda. The solution of sodium acetate obtained by the neutralisation of the acetic acid with caustic soda, can be readily concentrated by heating, for example by heating with steam. This form of sodium acetate melts in a similar fashion to the trihydrate form. Partially hydrated sodium acetate can also be obtained by neutralising acetic acid (either glacial or in solution) with a sodium salt.

The use of a spray-dried form of sodium acetate in water-softening tablets is described in our co-pending application GB 9822090.8.

Potassium Acetate

Potassium acetate exists in a an anhydrous form as either crystals, powder or flakes. It is rapidly deliquescent, and thus difficult to handle. It is also highly soluble (253 g/100 g of water at 20° C.) and has a molecular weight of 98 g. It melts at 292° C.

Other Granule Ingredient(s)

The other material present in the co-granule with acetate may be any ingredient usually present in water-softening or detergent tablets, as described below, or a mixture of these, although it is preferred that it is not an organic detergent. It is further preferred that the other ingredients are selected from water-soluble and -insoluble inorganic compounds, and water-soluble organic salts having no more than 3 carbon atoms in the molecule.

One preference for this ingredient is that the remainder of the co-granule is solid basic material—this is particularly relevant to the second aspect of the invention, where the solid basic material can be the same as that used to neutralise the acetic acid. Typically, this compound may be a water-softening agent or a detergency builder, such as sodium or potassium carbonate. Alternatively, the remaining co-granule material can be a combination of solid basic material with other ingredients of the tablet.

Suitable materials for the co-granule may be ingredients which are less soluble than the form of acetate present in the co-granules. Alternatively they may be materials known as water-soluble disintegrants (which include materials having a water solubility of greater than 50 g/100 g at 20° C., form). On the other hand, the preferred materials may have a water solubility of less than 50 g/100 g at 20° C.

A solubility of at least 50 grams per 100 grams of water at 20° C. is an exceptionally high solubility: many materials which are classified so as water soluble are less soluble than this.

Some materials with a water solubility of at least 50 grams per 100 grams of water are listed below, with their solubilities expressed so as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Magnesium sulphate $7H_2O$ | 71 |

Materials with a water solubility of less than 50 grams per 100 grams of water (at 20° C.) include:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

A further water-soluble disintegrant is a special form of sodium tripolyphosphate, which has more than 50% of it in the anhydrous phase I form.

A process for the manufacture of particles containing such a high proportion of the phase I form of sodium tripolyphosphate by spray drying below 420° C. is given in U.S. Pat. No. 4,536,377. Desirably, this sodium tripolyphosphate is partially hydrated. The extent of hydration should be at least 1% by weight of the sodium tripolyphosphate in the particles. It may lie in a range from 2.5 to 4%, or it may be higher, e.g. up to 8%.

Water-softening Agent

It is particularly envisaged that this invention will be applied to tablets containing water-insoluble water softening agent, notably alkali-metal aluminosilicate. However, it could be applied in tablets containing a soluble water-softening agent such as a condensed phosphate. It could be applied in tablets containing both soluble and insoluble water softening agents—as might be used in countries where a restricted quantity of phosphate detergency builder is permitted.

It is very well known that water-insoluble alkali metal aluminosilicates can function to soften water, removing calcium ions and to a lesser extent magnesium ions by ion exchange. Aluminosilicates have become strongly favoured as environmentally acceptable detergency builders.

Alkali metal (preferably sodium) aluminosilicates used in tablets of the present invention may be either crystalline, amorphous or a mixture of the two. Such aluminosilicates generally have a calcium ion exchange capacity of at least 50 mg CaO per gram of aluminosilicate, comply with a general formula:

$$0.8\text{–}1.5Na_2O.Al_2O_3.0.8\text{–}6SiO_2$$

and incorporate some water. Preferred sodium aluminosilicates within the above formula contain 1.5–3.5 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, and mixtures thereof. Also of interest is the novel zeolite P described and claimed in EP 384070 (Unilever).

Another category of water-insoluble material which can function as a water-softening agent and detergency builder is the layered sodium silicate builders disclosed in U.S. Pat. Nos. 4,464,839 and 4,820,439 and also referred to in EP-A-551375.

These materials are defined in U.S. Pat. No. 4,820,439 as being crystalline layered sodium silicate of the general formula $$NaMSi_xO_{2x+1}.YH_2O$$

where

M denotes sodium or hydrogen, x is from 1.9 to 4 and y is from 0 to 20.

Quoted literature references describing the preparation of such materials include Glastechn. Ber. 37, 194–200 (1964), Zeitschrift für Kristallogr. 129, 396–404 (1969), Bull. Soc. Franc. Min. Crist., 95, 371–382 (1972) and Amer. Mineral, 62, 763–771 (1977). These materials also function to remove calcium and magnesium ions from water.

It is customary to use a water-soluble builder (water-softening agent) jointly with aluminosilicate, to enhance water-softening efficacy. Such water-soluble co-builders are generally used in an amount which is not greater than the amount of aluminosilicate, often less than half the amount of aluminosilicate. Water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Especially preferred supplementary builders are polycarboxylate polymers, more especially polyacrylates and acrylic/maleic copolymers, and monomeric polycarboxylates, more especially citric acid and its salts.

If a tablet contains only soluble water-softening agent, this may well be sodium tripolyphosphate, which is widely used as a detergency builder in some countries.

When using aluminosilicate or other insoluble detergency builder/water-softening agent it is often a commercial or legislative requirement to avoid phosphates. Some tablet compositions of the invention do not contain more than 5 wt % of inorganic phosphate builders, and are desirably substantially free of phosphate builders. However, tableted compositions containing some phosphate builder are also within the broad scope of the invention. In particular, a tablet or region thereof may contain at least 15 wt % insoluble water softening agent, with phosphate or other water-soluble builder in addition.

Polymer Binder

Tablets of this invention may include an organic water-soluble polymer, applied as a coating to some of the constituent particles, and serving as a binder when the particles are compacted into tablets. This polymer may be a polycarboxylate included as a supplementary builder, as mentioned earlier.

It is preferred that such a binder material, if present, should melt at a temperature of at least 35° C., better 40° C. or above, which is above ambient temperatures in many temperate countries. For use in hotter countries it will be preferable that the melting temperature is somewhat above 40° C., so as to be above the ambient temperature. For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight, notably 4000 or 6000, can also be used.

Other possibilities are polyvinyl pyrrolidone, and polyacrylates and water-soluble acrylate copolymers.

The binder may suitably be applied to the particles by spraying, e.g. as a solution or dispersion. If used, the binder is preferably used in an amount within the range from 0.1 to 10% by weight of the tablet composition, more preferably the amount is at least 1% or even at least 3% by weight of the tablets. Preferably the amount is not over 8% or even 6% by weight unless the binder serves some other additional function.

Tablets may include other ingredients which aid tableting. Tablet lubricants include calcium, magnesium and zinc soaps (especially stearates), talc, glyceryl behapate, sugar Myvatex™ TL ex Eastman Kodak, polyethylene glycols, and colloidal silicas (for example, Alusil™ ex Crosfield Chemicals Ltd).

As mentioned above, compositions of this invention may be embodied as detergent compositions for use in fabric washing, in which case the composition will generally contain from 15 to 60% by weight of detergency builder, notably water-insoluble aluminosilicate, together with 5 to 50% by weight of one or more detergent-active compounds. Such a composition may well contain from 0.5 to 15% by weight of a supplementary builder, notably polycarboxylate, and also other detergency ingredients.

Another possibility is that the invention may be embodied in tablets whose principal or sole function is that of removing water hardness. In such tablets the water-softening agents, especially water-insoluble aluminosilicate, may provide from 50 to 90% of the tablet composition. A water-soluble supplementary builder may well be included, for instance in an amount from 2% to 30 wt % of the composition.

Water-softening tablets embodying this invention may include some detergent active. Notably, water-softening tablets may include nonionic surfactant which can act as a lubricant during tablet manufacture and as a low foaming detergent during use. The amount may be small, e.g. from 0.2 or 0.5% by weight of the composition up to 3% or 5% by weight.

Detergent Tablets

Tablets for use in fabric washing will usually contain from 2% or 5% up to 50 wt %, more preferably from 5% or 8% up to 40 wt % of detergent-active compounds. These will most usually be anionic and nonionic surfactants and mixtures of the two. Amphoteric (including zwitterionic) and less commonly cationic detergents can also be used.

Anionic Surfactant Compounds

Anionic detergent-active compounds may be present in an amount of from 0.5 to 40 wt %, preferably from 2% or 4% to 30% or 40 wt %.

Synthetic (i.e. non-soap) anionic surfactants are well known to those skilled in the art. The anionic surfactant may comprise, wholly or predominantly, linear alkyl benzene sulphonate of the formula;

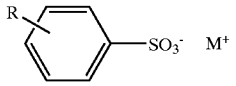

where R is linear alkyl of 8 to 15 carbon atoms and $M^+$ is a solubilising cation, especially sodium.

Primary alkyl sulphate having the formula; $ROSO_3^- M^+$ in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to non-soap anionic surfactant. Examples are sodium soaps derived from the fatty acids from coconut oil, beef tallow, sunflower or hardened rapeseed oil.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Amphoteric Surfactants

Amphoteric surfactants which may be used jointly with anionic or nonionic surfactants or both include amphopropionates of the formula:

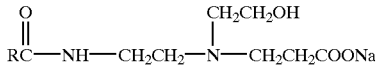

where RCO is a acyl group of 8 to 18 carbon atoms, especially coconut acyl.

The category of amphoteric surfactants also includes amine oxides and also zwitterionic surfactants, notably betaines of the general formula

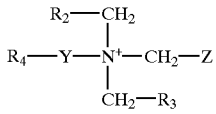

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$, Y is $CH_2$ or of the form $CONHCH_2CH_2CH_2$ (amidopropyl betaine); Z is either a $COO^-$ (carboxybetaine), or of the form $CHOHCH_2SO_3$— (sulfobetaine or hydroxy sultaine).

Another example of amphoteric surfactant is amine oxide of the form

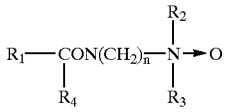

where $R_1$ is $C_{10}$ to $C_{20}$ alkyl or alkenyl, $R_2$, $R_3$ and $R_4$ are each hydrogen or $C_1$ to $C_4$ alkyl while n is from 1 to 5.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $ROSO_3^- M^+$ in which R is an alkyl or alkenyl chain of 8 to 18 carbon atoms especially 10 to 14 carbon atoms and $M^+$ is a solubilising cation, is commercially significant as an anionic detergent active. It is frequently the desired anionic detergent and may provide 75 to 100% of any anionic non-soap detergent in the composition.

In some forms of this invention the amount of non-soap anionic detergent lies in a range from 0.5 to 15 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other nonionic detergent compounds include alkylpolyglycosides, long-chain amine oxides, tertiary phosphine oxides, and dialkyl sulphoxides.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic detergent lies in a range from 4 to 40%, better 4 or 5 to 30% by weight of the composition.

Many nonionic detergent-active compounds are liquids. These may be absorbed on a porous carrier. Preferred carriers include zeolite; zeolite granulated with other materials, for example Wessalith CS™, Wessalith CD™ or Vegabond GB™; sodium perborate monohydrate; Burkeite (spray-dried sodium carbonate and sodium sulphate as disclosed in EP-A-221776 of Unilever); and layered sodium silicate as described in U.S. Pat. No. 4,664,839.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate and sodium percarbonate; and perbenzoic acid precursors. The quaternary ammonium and phosphonium bleach activators disclosed in U.S. Pat. Nos. 4,751,015 and 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase™, as supplied by Gist-Brocades N.V., Delft, Holland, and Alcalase™, and Savinase™, as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal™ DMS or Tinopal CBS available from Ciba-Geigy AG, Basel, Switzerland. Tinopal DMS is disodium 4,4'bis-(2-morpholino-4-anilino-s-triazin-6-ylamino)stilbene disulphonate; and Tinopal CBS is disodium 2,2'-bis-(phenylstyryl)disulphonate.

An antifoam material is advantageously included, especially if the detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or preferably alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A tablet of this invention, or a discrete region of such a tablet, is a matrix of compacted particles.

Preferably the particulate composition has an average particle size in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 500 g/liter, and advantageously at least 700 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

A tablet of the invention may be either homogeneous or heterogeneous. In the present specification, the term "homogeneous" is used to mean a tablet produced by compaction of a single particulate composition, but does not imply that all the particles of that composition will necessarily be of identical composition.

The term "heterogeneous" is used to mean a tablet consisting of a plurality of discrete regions, for example layers, inserts or coatings, each derived by compaction from a particulate composition and large enough to constitute from 10 to 90% of the weight of the whole tablet.

It is possible that the acetate co-granules will be contained within one or more but not all such discrete regions of a heterogeneous tablet, such as a layer or an insert. The presence of such a layer or insert could assist break up of the entire tablet when placed in water.

Tableting

Tableting entails compaction of a particulate composition. A variety of tableting machinery is known, and can be used. Generally it will function by stamping a quantity of the particulate composition which is confined in a die. Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

Embodiments of the present invention will now be described by way of example only.

EXAMPLE 1

In order to make a co-granule containing sodium acetate, glacial acetic acid was mixed with water in a weight ratio of 4:3. This liquid was then added to sodium carbonate (light soda ash) in a lab-scale mixer with a ratio of liquid:solid of 1:2.08. The tip speed of the mixer was approximately 25 m/s. Granulation took place within 12–14 seconds. The resulting co-granules (A) contained 55% sodium carbonate and 45% sodium acetate trihydrate.

EXAMPLE 2

Co-granules of sodium acetate and sodium carbonate were prepared using an alternative method, in which sodium acetate trihydrate was heated to a temperature of 70° C., and the resulting 'molten' salt was granulated with sodium carbonate (light soda ash) using a similar fashion to above with a ratio of liquid to solid of 1:1.85. The resulting co-granules (B) contained 65% sodium carbonate and 35% sodium acetate trihydrate.

EXAMPLE 3

Tablets for use in fabric washing were made, starting with a base powder of the following composition:

| Ingredients | Weight % |
|---|---|
| Zeolite A24 (anhydrous) | 46.65 |
| Sodium carbonate (anhydrous) | 6.68 |
| Sodium acetate (anhydrous) | 3.56 |
| Sodium LAS | 20.84 |
| Nonionic 3EO | 3.19 |
| Nonionic 7EO | 5.97 |
| Soap | 1.62 |
| Sodium carboxymethyl cellulose | 0.64 |
| Water/and other minor ingredients | 10.85 |
| Total | 100.00 |

This powder was mixed with a tablet disintegrant and other detergent ingredients as tabulated below.

| Ingredient | Amount (wt. %) |
|---|---|
| Base powder | 50.07 |
| Sodium percarbonate | 15.00 |
| Soil release polymer | 1.09 |
| Fluorescer | 1.24 |
| Anti-foam granules | 1.79 |
| Acrylate-maleate copolymer | 1.19 |
| TAED (83% active) granule | 5.06 |
| Heavy metal sequestrant | 0.73 |
| Sodium disilicate | 3.18 |
| Coloured speckles | 1.39 |

-continued

| Ingredient | Amount (wt. %) |
|---|---|
| Enzymes | 0.88 |
| Perfume | 0.38 |
| Disintegrant | 18.00 |
| Total | 100.00 |

The disintegrants were used are as follows:
Tablet A: Co-granule A
Tablet B: Co-granule B
Tablet C: Sodium acetate trihydrate (from Verdugt)
Tablet D: Mixture of 55% Sodium carbonate and 45% sodium acetate trihydrate.

Thus the amount of sodium carbonate and sodium acetate trihydrate in tablet D was the same as that in tablet A.

42.5 g portions of each composition were made into cylindrical tablets of 44 mm diameter, using a Grasby Specac labscale tablet press with varying compaction force.

The strength of the tablets, in their dry state as made on the press, was determined as the force, expressed in Newtons, needed to break the tablet, as measured using a Chatillon type universal testing instrument to apply compressive force on a diameter (i.e. perpendicular to the axis of a cylindrical tablet). The desired tablet strength was 59 N, although most tablets were made with two different strengths, one below and one above 59 N.

The speed of dissolution of the tablets was measured by a test procedure in which two of the tablets are placed on a plastic sieve with 2 mm mesh size which was immersed in 9 liters of demineralised water at ambient temperature of 20° C. and rotated at 200 rpm. The water conductivity was monitored over a period of 30 minutes or until it reached a constant value.

The time for break up and dispersion of the tablets ($T_{90}$) was taken as the time for change in the water conductivity to reach 90% of its final magnitude. This was also confirmed by visual observation of the material remaining on the rotating sieve. For tablets where a strength of 59 N was not achieved, the results were linearly interpolated to give a predicted value of $T_{90}$ at a strength of 59 N.

| | Mol/100 g of Ac in | Acetate in co-granules | | $T_{90}$ |
|---|---|---|---|---|
| Tablet | Tablet | Mol/100 g | % | (minutes) |
| A | 0.060 | 0.33 | 45% trihydrate | 1.96 (1) |
| B | 0.046 | 0.26 | 35% trihydrate | 2.70 |
| C* | 0.132 | — | — | 2.04 (2) |
| D* | 0.060 | — | — | 3.70 |

*comparative examples
1 Linear interpolation from: $F_{max}$ = 53.1 N, T90 = 1.78 minutes; $F_{max}$ = 74.6 n, T90 = 2.42 minutes
2 Linear interpolation from: $F_{max}$ 43.6 n, T90 = 1.80 minutes; $F_{max}$ 62.3 n; T90 = 2.10 minutes These results show that by employing acetate in a co-granular form, a great deal less acetate is required to provide adequate dissolution times. Furthermore, by comparing tablets A and D, use of the co-granular form of acetate compared to simply dry-mixing of the acetate cuts the dissolution time almost in half.

What is claimed is:

1. A method of making a tablet of a compacted particulate composition wherein the tablet or a region thereof comprises from 15 to 90% by weight of a water-insoluble softening agent, sodium and/or potassium acetate, 5% to 60% by weight of one or more detergent-active components, wherein the tablet or region contains at least 10% by weight of co-granules which contain both the acetate and at least one other ingredient selected from the group consisting of water-soluble and insoluble inorganic compounds and water-soluble organic compounds having no more than 3 carbon atoms in the molecule, the content of the acetate in these co-granules being at least 0.1 mole per 100 gram of co-granules and the other ingredient being at least 5% by weight of the co-granules, comprising the steps of neutralizing acetic acid with a solid basic compound and granulating the resulting mixture wherein the amount of solids added to the acetic acid includes sufficient basic compound to neutralize the acetic acid, and to constitute the at least 5% by weight of the other ingredient which forms co-granules with the acetate, and further comprising the step of adding the co-granules to the remaining ingredients of the particulate composition followed by compacting the composition into a tablet or a region of a tablet.

2. A method according to claim 1, wherein the content of the acetate in the co-granules is at least 0.2 mole per 100 gram of co-granules.

3. A method according to claim 1, wherein the amount of the co-granules in the tablet or region thereof is 13% by weight.

4. A method according to claim 1, wherein the acetate is sodium acetate.

5. A method according to claim 4, wherein the molar ratio of water in the co-granules to the sodium acetate in the co-granules, as anhydrous, is between 2.5:1 and 3.5:1.

6. A method according to claim 1, wherein the majority of the acetate in the tablet or region thereof is in the co-granules.

7. A method according to claim 1, wherein the other ingredient is a detergency builder or water-softening agent.

8. A method according to claim 7, wherein the other ingredient is sodium and/or potassium carbonate.

9. A method according to claim 1, wherein the other ingredient is a water-soluble disintegrant.

10. A method according to claim 1, wherein the tablet or said region thereof comprises from 15 to 60% by weight of water-insoluble softening agent together with 5% to 60% by weight of one or more detergent-active compounds.

11. A method of making a tablet of a compacted particulate composition wherein the tablet or a region thereof comprises from 15 to 90% by weight of a water-insoluble softening agent, sodium acetate, 5% to 60% by weight of one or more detergent-active components, wherein the tablet or region contains at least 10% by weight of co-granules which contain both the acetate and at least one other ingredient selected from the group consisting of water-soluble and insoluble inorganic compounds and water-soluble organic compounds having no more than 3 carbon atoms in the molecule, the content of the acetate in these co-granules being at least 0.1 mole per 100 gram of co-granules, and the other ingredient being at least 5% by weight of the co-granules, comprising the steps of heating a hydrated form of sodium acetate to above its melting point, and granulating the resulting melt with the at least one other ingredient to form co-granules, and further comprising the step of adding the co-granules to the remaining ingredients of the particulate composition followed by compacting the composition into a tablet or a region of a tablet.

12. A method according to claim 11, wherein the content of the acetate in the co-granules is at least 0.2 mole per 100 gram of co-granules.

13. A method according to claim 11, wherein the amount of the co-granules in the tablet or region thereof is 13% by weight.

14. A method according to claim 11, wherein the acetate is sodium acetate.

15. A method according to claim 14, wherein the molar ratio of water in the co-granules to the sodium acetate in the co-granules, as anhydrous, is between 2.5:1 and 3.5:1.

16. A method according to claim 11, wherein the majority of the acetate in the tablet or region thereof is in the co-granules.

17. A method according to claim 11, wherein the other ingredient is a detergency builder or water-softening agent.

18. A method according to claim 17, wherein the other ingredient is sodium and/or potassium carbonate.

19. A method according to claim 11, wherein the other ingredient is a water-soluble disintegrant.

20. A method according to claim 11, wherein the tablet or said region thereof comprises from 15 to 60% by weight of water-insoluble softening agent together with 5% to 60% by weight of one or more detergent active compounds.

* * * * *